US007244684B2

(12) United States Patent
Hexels

(10) Patent No.: US 7,244,684 B2
(45) Date of Patent: Jul. 17, 2007

(54) THERMAL CAMOUFLAGE SHEET

(75) Inventor: Gerd Hexels, Nettetal (DE)

(73) Assignee: Texplorer GmbH, Nettetal (DE)

( * ) Notice: Subject to any disclaimer, the term of this patent is extended or adjusted under 35 U.S.C. 154(b) by 181 days.

(21) Appl. No.: 10/733,859

(22) Filed: Dec. 11, 2003

(65) Prior Publication Data

US 2004/0127124 A1 Jul. 1, 2004

(30) Foreign Application Priority Data

Dec. 12, 2002 (DE) ..... 102 58 014

(51) Int. Cl.

| | |
|---|---|
| ***B32B 27/04*** | (2006.01) |
| ***B32B 27/12*** | (2006.01) |
| ***B32B 27/20*** | (2006.01) |
| ***B32B 27/40*** | (2006.01) |
| ***F41H 3/02*** | (2006.01) |

(52) U.S. Cl. ..... 442/64; 442/65; 442/70; 442/71; 442/72; 442/73; 442/74; 442/75; 442/131; 442/132; 442/133; 442/180; 428/919; 2/900

(58) Field of Classification Search ..... 442/64, 442/65, 70, 71, 72, 73, 74, 75, 131, 132, 442/133, 180; 2/900; 428/919
See application file for complete search history.

(56) References Cited

U.S. PATENT DOCUMENTS

| | | | | |
|---|---|---|---|---|
| 2,817,371 A | * | 12/1957 | Bussiere | 139/383 R |
| 4,308,882 A | * | 1/1982 | Pusch et al. | 135/93 |
| 4,347,284 A | | 8/1982 | Tsutomu et al. | |
| 4,758,465 A | * | 7/1988 | McKinney et al. | 442/139 |
| 5,348,789 A | | 9/1994 | Hellwig | 428/135 |
| 5,514,457 A | * | 5/1996 | Fels et al. | 442/191 |

FOREIGN PATENT DOCUMENTS

| | | | |
|---|---|---|---|
| DE | 34 32 998 A1 | | 5/1986 |
| DE | 40 23 287 A1 | | 7/1990 |
| DE | 289 430 A7 | | 5/1991 |
| DE | 297 16 362.0 | | 9/1997 |
| DE | 20212487 | * | 8/2002 |
| EP | 0 065 207 A1 | | 11/1982 |
| EP | 1 389 727 A2 | | 2/2004 |
| GB | 1 411 577 | | 10/1975 |

* cited by examiner

*Primary Examiner*—Ula C. Ruddock
(74) *Attorney, Agent, or Firm*—Davis Bujold & Daniels, P.L.L.C.

(57) ABSTRACT

A thermal camouflage sheet for covering heat sources against identification in a thermal image, having a base textile with a glass filament, has a coating which contains aluminum powder on one side and has a coating which contains color pigments on the other side. The remission values of the color pigments are in a range which allows camouflaging in the visual-optical and near infrared. The coating which contains color pigments is in the form of a polyurethane coating or polyvinylidene fluoride coating.

19 Claims, 1 Drawing Sheet

THERMAL CAMOUFLAGE SHEET

This application claims priority from German Application Serial No. 102 58 014.6 filed Dec. 12, 2003.

FIELD OF THE INVENTION

The invention relates to a thermal camouflage sheet.

BACKGROUND OF THE INVENTION

A thermal camouflage sheet of this generic type is known from DE 297 16 362.

Camouflage nets are used for military camouflaging of fixed and mobile military facilities and devices, such as motor vehicles, armored vehicles and the like. The camouflage nets are in this case intended to achieve not only camouflage against infrared cameras or thermal imaging detectors, but also against radar detection. The camouflage net is in this case intended to prevent microwaves that strike an object from being reflected back from it. A further aim is to prevent the capability for identification by means of sensors in the infrared or thermal imaging band. For this purpose, a camouflage net has an appropriately matched hole structure in the network with a specific material composition, in order to provide protection both in the visible band and in the near infrared band, to achieve good attenuation levels over a broad spectrum in the microwave band, and to produce low emissions in the thermal imaging band (see, for example, DE 40 23 287 C2). Camouflage nets such as these generally satisfy their purpose. However, camouflaging is problematic when a hot spot occurs locally under the camouflage net, for example from the engine of a vehicle or else from a stationary engine. This local hot spot can be located on the basis of the network structure in the infrared band, for example in the far infrared band.

In order to avoid such identification, covering sheets are already known from practical use, by means of which the hot spot is covered. The known sheets have various disadvantages, however, for example poor mechanical strength and a restricted temperature range with a risk of burning if the temperature is too high. This results in restricted handling for rugged use in practice.

The document which forms this generic prior art describes a thermal camouflage sheet for covering heat sources, which has considerable improvements in comparison to the prior art mentioned above. The thermal camouflage sheet of this generic type has, on the side facing the object to be covered, a coating with a silicone elastomer which contains aluminum powder. The other side is provided with a silicone elastomer which contains metal pigments, whose remission values are in the visual-optical camouflage band. The thermal camouflage sheet is therefore effective within a wide temperature range, while having better mechanical strength and greater resistance to temperature at the same time.

In a further development of the thermal camouflage sheet of this generic type, however, it has been found that, despite the improved mechanical strength, fiber fractures and destruction of the coating can occur even at a relatively early stage, due to kinking. This is particularly true in a refinement of the thermal camouflage sheet of this generic type based on a warp knit. Furthermore, trials have shown that the thermal camouflage sheet of this generic type is subject to damage and/or is destroyed at the kink points when stored for lengthy periods. A further disadvantage of the thermal camouflage sheets which are coated on the basis of silicone elastomer is that the coloring is restricted in the visible band and in the near infrared (650 to 1250 nanometers). Furthermore, that surface of the thermal camouflage sheet which is coated with the silicone elastomer glistens, thus increasing the risk of discovery. A further disadvantage is that it is impossible to stick article numbers to that surface of the thermal camouflage sheet which is coated with silicone elastomer.

An improvement is likewise desirable with regard to the reflection on that side of the thermal camouflage sheet which faces the object to be covered, and which has a silicone elastomer coating that is provided with aluminum powder.

The present invention is therefore based on the object of overcoming the disadvantages of the prior art mentioned above, in particular of further improving the thermal camouflage sheets of the generic type, so that the capability to use and store the thermal camouflage sheets is improved, such that as far as possible all colors that also occur naturally can be simulated, and values in the infrared can largely be achieved corresponding to those in nature, while a matt surface can also be achieved.

SUMMARY OF THE INVENTION

Since the coating which contains the color pigments, that is to say the colored side of the thermal camouflage sheet which faces away from the object to be covered, has a polyurethane coating (or polyurethane elastomers) or a polyvinylidene fluoride coating (or polyvinylidene fluoride), all colors which occur naturally can be simulated. The thermal camouflage sheet of the generic type, on the basis of the silicone elastomer coating, could be produced only in a very restricted range of colors. It is now possible to provide not only the normal green optics, which were used specifically for camouflage nets for use in woodland, but also to provide optics matched to the desert (sand colors) or to the arctic (white).

Trials have shown that the polyvinylidene coating allows reflection values to be achieved which are considerably better than those of a polyurethane coating.

The polyurethane coating according to the invention or the polyvinylidene fluoride coating (PVDF) for the thermal camouflage sheets allows values to be produced in the infrared band which correspond to those occurring naturally.

The polyurethane coating or polyvinylidene fluoride coating advantageously make it possible to produce a matt surface, thus reducing the detection capability.

As trials have shown, article numbers can easily be applied to the polyurethane coating or to the polyvinylidene fluoride coating.

In comparison to the reflectometer values for thermal camouflage sheets of this generic type, which were 2.8 at 60° and 1.4 at 85°, the new thermal camouflage sheets according to the invention and based on the polyurethane coating or the polyvinylidene fluoride coating have produced values which are 2.2 at 60° and 1.6 at 85°. The significant factor in this case is that, although the difference on the basis of the values is not very significant, it is clearly evident however, from a visual comparison of the thermal camouflage sheets of the generic type with the new thermal camouflage sheets according to the invention that the thermal camouflage sheet of this generic type glints to a greater extent, and can thus be detected more easily.

The thermal camouflage sheet according to the invention is not combustible. This means that it can be applied safely even directly to hot spots.

It is advantageous for the base textile to be in the form of a glass filament fabric, preferably a cross-twill.

Trials have shown that the thermal camouflage sheet provided with the polyurethane coating or the polyvinylidene fluoride coating has particularly good resistance to kinking since it is in the form of a web based on cross-twill binding, preferably cross-twill 01 02. This allows the life of the thermal camouflage sheets to be lengthened considerably, particularly when stored for lengthy periods and when the thermal camouflage sheets are in use. The comparison with the thermal camouflage sheet of the generic type, which was preferably in the form of a warp knit, resulted in the in-use life and storage life being quintupled.

A further advantage is that, in addition to improving the kink resistance, this also results in a strength increase. The thermal camouflage sheet of the generic type based on a warp knit had an increased strength of 1 900 N/5 cm in the warp and weft directions in comparison to the prior art. The thermal camouflage sheet according to the invention based on 01 02 warp knit has a strength of 4 000 N/5 cm in the warp and 3 000 N/5 cm in the weft.

According to the invention, it is possible to provide for the coating which contains aluminum powder to be in the form of a silicone elastomer coating and/or a polyurethane coating.

The aluminum powder in conjunction with the silicone elastomers and/or the polyurethane ensures appropriately high thermal reflection while, on the other hand, the polyurethane or the polyvinylidene fluoride in conjunction with the color pigments ensures an identification reduction in the visual-optical band and in the infrared band. The color pigments together with the polyurethane coating and/or the polyvinylidene fluoride coating allow a surface coloring to be achieved which is matched to the environment and/or to a camouflage net located above it.

It is advantageous for the coating which contains the aluminum powder and/or the color pigments to be applied by means of a transfer coating method.

The advantage of the transfer coating method is that the glass fibers are not coated directly. This therefore results in a softer, more flexible material, which is less susceptible to crack formation. The surface is smoother, since it is applied only over the surface, while all of the glass fibers are nevertheless covered. In contrast to direct coating, which is also possible in principle, this does not result in any "peaks or troughs" in the fabric.

With regard to the coating of the aluminized side, it has been found that a coating application by means of a transfer method improves the IR activity of the aluminum side by several times. This increase in the activity makes it possible to achieve a reflection of 80 to 100% in the solar band (from 0.4 micrometers to 4 micrometers). Values of more than 50% are achieved in the upper thermal band (from 4 micrometers to 13 micrometers).

In trials, it has been found that the aluminum parts are considerably better aligned by application by means of the transfer coating method than by application by means of a direct painting method. This results in a particularly smooth surface.

In this case, it has been found to be advantageous for the aluminum layer to have an optical density of 2.9 to 3.5%. In this case, it has likewise been found to be advantageous for the coating on the aluminum side to have a weight of 40 to 50 g/m$^2$.

In one refinement of the invention, it is possible to provide for the base textile to be in the form of a warp knit, with a warp thread which in each case represents a glass filament and a weft thread being linked to one another by means of a plastic thread system.

Depending on the application, the warp knit can be designed so as to achieve the strength of the fabric or a desired elasticity, with greater elasticity resulting in a reduction in breakage of the base textile and thus reducing the wear of the thermal camouflage sheet.

The final characteristic of the polyurethane elastomer can be tailor-made by means of a wide vibration range of warp extensions and/or crosslinks of the prepolymer. If silicone elastomers are used instead of the polyurethane on the side that is provided with the aluminum powder, this can also be crosslinked.

Very good values with regard to thermal reflection have been achieved with a proportion of 15 to 40% by weight of aluminum powder in the polyurethane orthe silicone elastomer on the side of the thermal camouflage sheet facing the object to be covered, with the proportion in the case of a glass fiber fabric preferably being 30% by weight, and in the case of a base textile in the form of a warp knit being 20 to 40% by weight.

The color pigments which are added to the polyurethane or polyvinylidene fluoride on the other side should advantageously be chosen such that, on the outside, the polyurethane or the polyvinylidene fluoride contains 10 to 50% color pigments, preferably 30% color pigments. The color pigments and the polyurethane coating or the polyvinylidene fluoride coating make it possible to visually simulate all colors that occur naturally.

In this case, it is advantageous for the polyurethane or polyvinylidene fluoride to contain color pigments whose remission values are in the range from light green to dark green, for which purpose the color pigments may have metal pigments which preferably contain chromium oxides, which have been found to be particularly suitable for this purpose.

In order to achieve sufficient robustness and strength, it is advantageous to use a base textile which has a weight per unit area of 300 to 450 g/m$^2$, preferably 400 g/m$^2$.

30 to 90 g/m$^2$ per side has been found to be most suitable for the weight per unit area values for the polyurethane to be applied on both sides (if this polyurethane is provided on both sides), and the coating should preferably have a weight of 70 to 80 g/m$^2$.

In one development of the invention, furthermore, it is possible to provide for the edges of the thermal camouflage sheet to be sealed by cold-crosslinked polyurethane. The thermal camouflage sheet according to the invention is prefabricated in a specific size. In this case, the thermal camouflage sheet is conventionally cut. Sealing of the thermal camouflage sheet after cutting to size, using a cold-crosslinked polyurethane, prevents the thermal camouflage sheet from becoming unraveled. This particularly advantageously prevents bright spots which have become unraveled in the coating that contains the aluminum powder, or points on the inner face of the fiber which have not been coated emerging to the exterior, and thus having a negative influence on the detection capability.

BRIEF DESCRIPTION OF THE DRAWING

The invention will now be described, by way of example, with reference to the accompanying drawings in which.

DETAILED DESCRIPTION OF THE INVENTION

Thermal camouflage sheets have already been known for a long time on the basis of their operational purpose and on the basis of their fundamental design as a knit or warp knit, and as a fabric, in which context reference should be made to DE 297 16 362, for which reason only those features which are essential to the invention will be described in more detail in the following text.

Figure 1:
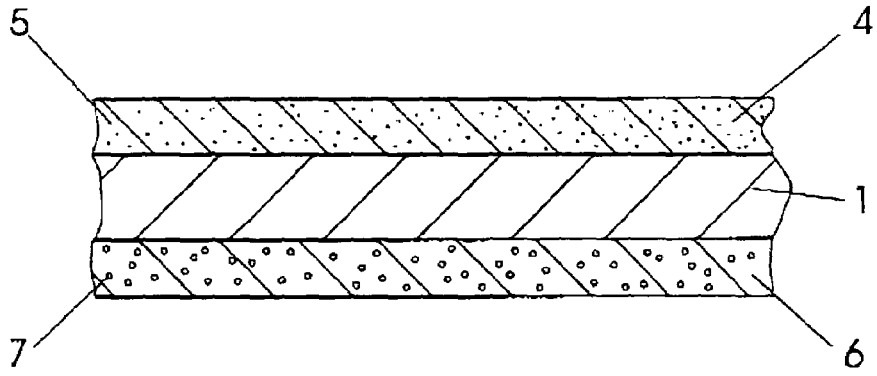
FIG. 1 shows a highly schematic composition of a thermal camouflage sheet according to the invention, highly enlarged and in the form of a cross section.

In the exemplary embodiment shown in FIG. 1, a base textile 1 which is in the form of a glass filament fabric in a twill binding, preferably a cross-twill with a weight per unit area of 400 g/m$^2$, is used as the basis for the thermal camouflage sheet.

Figure 2:
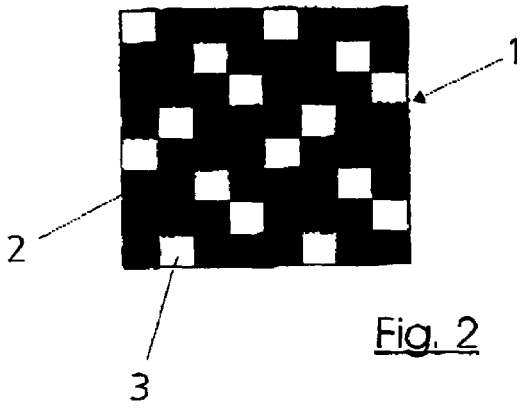
FIG. 2 shows an illustration of a binding cartridge for a 01 02 cross-twill.

In this context, FIG. 2 shows one particularly preferred refinement of the base textile 1 as a 01 02 cross-twill. In this case, the vertical columns of the illustrated binding cartridge represent the warp threads 2, and the horizontal rows represent weft threads 3. If the warp thread 2 is located on the surface, the area of the binding cartridge illustrated in FIG. 2 is filled, and when the weft thread 3 is at the top, the area is empty.

The base textile 1 illustrated in FIG. 1 has a polyurethane coating 4 on the side facing away from the object to be covered, that is to say on the outside which is directed upward. The outside is in this case preferably provided with the polyurethane coating 4 by means of a direct painting method or transfer coating method. A proportion of 10 to 50% of color pigments 5, preferably 30% of color pigments 5, is added to the polyurethane coating 4. In this case, the color pigments 5 have metal pigments which are not illustrated in any more detail, but which may contain chromium oxides. By way of example, the polyurethane coating 4 may have a weight per unit area of 30 to 90 g/m$^2$.

In order to achieve particularly good reflection values, a polyvinylidene coating can also be provided instead of the polyurethane coating 4. This is preferably applied by means of the transfer coating method. The values and embodiments stated in the exemplary embodiment also apply in an identical manner to polyvinylidene coating.

It is particularly advantageously suitable for the metal pigments to be in the form of chromium oxides if the aim is to achieve good remission values in the range from light green to dark green, and thus camouflaging in the visual-optical and near infrared bands.

For a dark-green color, for example, the remission values may be 8 at 400 nanometers, 10 at 550 nanometers, 8 at 600 nanometers, 8 at 650 nanometers, 37 at 750 nanometers, 46 at 800 nanometers, 44 at 1200 nanometers and 44 at 1800 nanometers. The sharp rise at 750 nanometers is referred to as the chlorophyll discontinuity and is sensitive to the behavior of deciduous trees in this wavelength band.

The base textile 1 illustrated in FIG. 1 is likewise coated on the side facing the object to be covered with a polyurethane coating 6 to which 15 to 40% by weight of aluminum powder 7 is added. The polyurethane coating 6 may in this case likewise be applied using the direct painting method. A polyurethane coating 6 which can be crosslinked is particularly suitable for this purpose. Analogously to this, the polyurethane coating 4 may also be in the form of a polyurethane coating which can be crosslinked.

The polyurethane coating 6 which is provided with the aluminum powder 7 may in one alternative embodiment also be in the form of a silicone elastomer coating that is provided with aluminum powder 7, since only the degree of reflection is significant on this side of the base textile 1.

The reflection values for the thermal camouflage sheet according to the invention are more than 50% in the spectrum from 0.4 to 2.5 nanometers.

The silicone elastomer which is used instead of the polyurethane coating 6 can likewise be applied using the direct painting method, and may be in the form of a silicone elastomer that can be crosslinked.

A hydrogen polysiloxane with a high proportion of reactive Si—H may be used as the crosslinking agent. 2% by weight of silicone elastomer is added in this case.

After painting on, heating to about 150° is carried out for a period of three minutes, for vulcanization. The vulcanization time is in this case governed by the temperature that is used. This means that a shorter vulcanization time results for higher temperatures, and vice versa.

Figure 3:
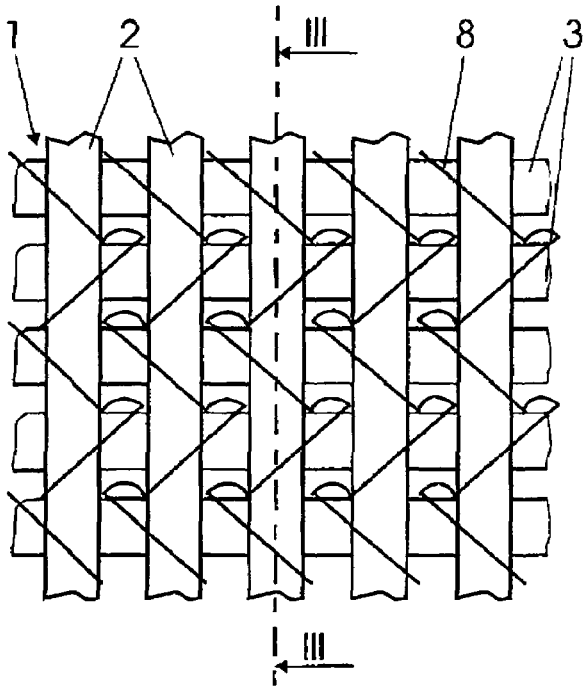
FIG. 3 shows a plan view of a base textile in the form of a warp knit.

The thermal camouflage sheet may be subjected to a temperature range of more than 1000° for two or more minutes without any damage occurring, as a result of which the thermal camouflage sheet is virtually incombustible. As an alternative to the base textile in the form of a glass filament fabric as illustrated in FIG. 1 and FIG. 2, an embodiment of the base textile 1 in the form of a warp knit is illustrated in FIG. 3.

The base textile 1 which is produced with a weft entry on a double-rib loom machine and is in the form of a warp knit has warp threads 2 composed of glass fibers and weft threads 3 composed of glass fibers or glass filaments which are not passed over and under one another as in the refinement of the base textile shown in FIG. 1, but lie one on top of the other and are bonded to one another by means of an elastic plastic thread system 8, which represents a polyester binding thread.

The advantages according to the invention can also be essentially illustrated by means of a refinement of the base textile 1 as a warp knit. However, trials have shown that a refinement of the base textile 1 is particularly suitable in the form of a glass filament fabric or a fabric preferably according to the cross-twill binding illustrated in FIG. 2.

The invention claimed is:

1. A thermal camouflage sheet for covering a heat source against identification in a thermal image, the thermal camouflage sheet comprising:

a base textile made of a glass filament and having an inner side facing toward the heat source and an outer side facing away from the heat surface;

the outer side of the base textile having a first surface coating consisting of one of polyurethane and polyvinylidene fluoride (PVDF) containing color pigments with remission values of the color pigments being in the range of visual-optical camouflage; and the inner side of the base textile having a second surface coating consisting of a polyurethane containing aluminum powder and having a first side facing toward the heat source, wherein the first side of the second surface coating is smooth relative to a texture of the inner side of the base textile, thereby increasing a thermal reflectivity of the thermal camouflage sheet toward the heat source.

2. The thermal camouflage sheet according to claim 1, wherein the base textile (1) is a glass filament fabric.

3. The thermal camouflage sheet according to claim 2, wherein the glass filament fabric (1) is a twill binding.

4. The thermal camouflage sheet according to claim 3, wherein the glass filament fabric (1) is a cross-twill.

5. The thermal camouflage sheet according to claim 1, wherein the base textile (1) is a warp knit, with a warp thread (2) which represents a glass filament and a weft thread (3) being linked to one another by a plastic thread system (8).

6. The thermal camouflage sheet according to claim 5, wherein the plastic thread system (8) is a binding thread comprising polyester.

7. The thermal camouflage sheet according to claim 1, wherein the color pigments (5) contain metal pigments.

8. The thermal camouflage sheet according to claim 7, wherein the metal pigments contain chromium oxide which provides a green color tone.

9. The thermal camouflage sheet according to claim 1, wherein the polyurethane (4, 6) is crosslinked.

10. The thermal camouflage sheet according to claim 9, wherein at least one of urea and urethane is provided for crosslinking of the polyurethane (4, 6).

11. The thermal camouflage sheet according to claim 1, wherein edges of the thermal camouflage sheet are sealed with cold-crosslinked polyurethane.

12. The thermal camouflage sheet according to claim 1, wherein a proportion of aluminum powder (7) in the polyurethane (6), on the inner side facing toward the heat source, is 20 to 40% by weight.

13. The thermal camouflage sheet according to claim 1, wherein on the outer side of the base textile, the polyurethane (4) contains 10 to 50% color pigments.

14. The thermal camouflage sheet according to claim 1, wherein the polyurethane contains color pigments (5) with remission values which range from bright green to dark green.

15. The thermal camouflage sheet according to claim 1, wherein the base textile (1) has a weight per unit area of 300 to 450 g/m$^2$.

16. The thermal camouflage sheet according to claim 15, wherein the base textile (1) has a weight per unit area of 400 g/m$^2$.

17. The thermal camouflage sheet according to claim 1, wherein the coating (4) which contains at least one of aluminum powder (7) and the color pigments (5) is applied by a transfer coating method.

18. A thermal camouflage sheet for covering a heat source against identification in a thermal image, the thermal camouflage sheet comprising:

a base textile comprising a cross-twill woven glass filament fabric and having an inner side facing toward the heat source and an outer side facing away from the heat source;

the outer side of the base textile having a first surface coating containing color pigments with remission values of the color pigments being in the range of visual-optical camouflage; and the inner side of the base textile having a second surface coating consisting of a polyurethane containing aluminum powder and having a first side facing toward the heat source and the first side of the second surface coating is smooth relative to a texture of the inner side of the base textile thereby increasing a thermal reflectivity of the thermal camouflage sheet toward the heat source;

wherein the surface coating containing color pigments (5) on the outer side is one of a polyurethane coating (4) and a polyvinylidene fluoride coating (PVDF) contains about 10% to 50% color pigments, and the surface coating containing aluminum powder on the inner side is a polyurethane coating (6) containing a proportion of aluminum powder (7) of about 20% to 40% by weight.

19. A camouflage fabric for preventing thermal imaging of a heat source, the camouflage fabric consisting of:

a base textile comprising a glass filament fabric formed by at least one of a twill binding and a cross-twill binding having a weight per unit area of about 400 g/m$^2$;

a metallized thermal camouflage coating located on a side of the camouflage fabric facing toward the heat source and containing aluminum powder in a range of about 20% to 40% by weight, the metallized thermal camouflage coating having a first side facing toward the heat source in which the first side of the second surface coating is smooth relative to a texture of the base textile, thereby increasing a thermal reflectivity of the thermal camouflage fabric toward the heat source; and a visual-optical camouflage coating on a side of the camouflage fabric facing away from the heat source, the visual-optical camouflage coating containing color pigments in a range of about 10% to 50% applied directly to a second opposite side of the base textile, with remission values of the color pigments being in the range of visual-optical camouflage, forms an outermost surface of the second;

wherein the metallized thermal camouflage coating consists of a polyurethane coating, and the visual-optical camouflage coating consists of one of a polyurethane coating and a polyvinylidene fluoride coating (PVDF).

* * * * *